US005091952A

United States Patent [19]

Williamson et al.

[11] Patent Number: 5,091,952

[45] Date of Patent: Feb. 25, 1992

[54] FEEDBACK SUPPRESSION IN DIGITAL SIGNAL PROCESSING HEARING AIDS

[75] Inventors: Malcolm J. Williamson, Madison; Diane K. Bustamante, Marshall, both of Wis.

[73] Assignee: Wisconsin Alumni Research Foundation, Madison, Wis.

[21] Appl. No.: 269,987

[22] Filed: Nov. 10, 1988

[51] Int. Cl.[5] ..... H04R 25/00

[52] U.S. Cl. ..... 381/68.2; 381/68.4; 381/93; 381/94

[58] Field of Search ..... 381/68.2, 68, 68.4, 381/83, 93, 94

[56] References Cited

U.S. PATENT DOCUMENTS

| | | | |
|---|---|---|---|
| 4,185,168 | 1/1980 | Graupe et al. | 381/68.4 |
| 4,188,667 | 2/1980 | Graupe et al. | 381/68 |
| 4,449,237 | 5/1984 | Stepp et al. | 381/83 |
| 4,569,268 | 2/1986 | Futamase et al. | 381/63 |
| 4,611,300 | 9/1986 | Taylor, Jr. et al. | 381/63 |
| 4,628,789 | 12/1986 | Fujimori | 381/63 |
| 4,658,426 | 4/1987 | Chabries et al. | 381/93 |
| 4,689,818 | 8/1987 | Ammitzboll | 381/68 |
| 4,731,850 | 3/1988 | Levitt et al. | 381/68.2 |
| 4,752,903 | 6/1988 | Iwata et al. | 379/411 |
| 4,769,808 | 9/1988 | Kanemasa et al. | 379/410 |
| 4,783,818 | 11/1988 | Graupe et al. | 381/83 |
| 4,815,140 | 3/1989 | Wagner | 381/93 |
| 4,845,757 | 7/1989 | Wagner | 381/93 |
| 4,887,299 | 12/1989 | Cummins | 381/68.4 |

FOREIGN PATENT DOCUMENTS

| | | | |
|---|---|---|---|
| 209894 | 1/1987 | European Pat. Off. | 381/193 |
| 2738339 | 3/1979 | Fed. Rep. of Germany | 381/93 |
| 0130523 | 1/1978 | German Democratic Rep. | 381/83 |
| 60-96997 | 5/1985 | Japan | 381/93 |

OTHER PUBLICATIONS

"Adaptive Noise Cancelling: Principles and Applications"; Bernard Widrow et al.

*IEEE Transactions on Acoustics, Speech, and Signal Processing*, "Adaptive Linear Prediction Using a Sign Decorrelator", Jun. 1977, pp. 262–264.

*IEEE Transactions on Acoustics, Speech and Signal Processing*, "Adaptive Filter Performance with Non linearities in the Correlation Multiplier", Duttweiller, 8/1982, pp. 578–586.

*Adaptive Filters: Structures, Algorithms and Applications*, Michael Honig et al., Lukwer Academic Publishers, 1984, pp. 49–62.

Leland C. Best, "Digital Suppression of Acoustic Feedback in Hearing Aids", Master Science Thesis, Department of Electrical Engineering, University of Wyoming, Laramie, Wyoming, May, 1985.

*Primary Examiner*—Forester W. Isen

*Attorney, Agent, or Firm*—Foley & Lardner

[57] ABSTRACT

Acoustic feedback in digital signal processing hearing aids is suppressed by using signal processing techniques in the digital processor. A first processing technique causes the data to the main signal processing path in the digital signal processor to be delayed by varying amounts over time, preferably in a periodic manner, to disrupt the buildup of feedback resonances. In a second technique, a digital filter receives the input data and has its coefficients adjusted so that the output of the filter is substantially an optimal estimate of the current input sample based on past input samples. The output of the filter is then subtracted from the input signal data to provide difference signal data which substantially cancels out the resonant frequencies. In a third technique, the acoustic feedback path from the output to the input of the hearing aid is modeled in the digital signal processor as a delay and a linear filter. The output of the main signal processing path in the digital signal processor is delayed and the delayed data passed through the linear filter, with the output of the filter then being substracted from the input signal data to provide difference signal data which is provided to the main signal processing path. The coefficients of the digital filter in the feedback path are adjusted so that the signal passed through the feedback filter substantially corresponds to of the acoustic feedback signal to thereby cancel the same.

10 Claims, 4 Drawing Sheets

FEEDBACK SUPPRESSION IN DIGITAL SIGNAL PROCESSING HEARING AIDS

FIELD OF THE INVENTION

This invention pertains generally to the field of audio signal processing and particularly to hearing aids.

BACKGROUND OF THE INVENTION

The nature and severity of hearing loss among hearing impaired individuals varies widely. Some individuals with linear impairments, such as that resulting from conductive hearing loss, can benefit from the linear amplification provided by conventional hearing aids using analog signal processing. Such aids may have the capacity for limited spectral shaping of the amplified signal using fixed low pass or high pass filters to compensate for broad classes of spectrally related hearing deficits. However, many types of hearing loss, particularly those resulting from inner ear problems, can result in non-linear changes in an individual's auditory system. Individuals who suffer such problems may experience limited dynamic range such that the difference between the threshold hearing level and the discomfort level is relatively small. Individuals with loudness recruitment perceive a relatively small change in the intensity of sound above threshold as a relatively large change in the apparent loudness of the signal. In addition, the hearing loss of such individuals at some frequencies may be much greater than the loss at other frequencies and the spectral characteristics of this type of hearing loss can differ significantly from individual to individual.

Conventional hearing aids which provide pure linear amplification inevitably amplify the ambient noise as well as the desired signal, such as speech or music, and thus do not improve the signal to noise ratio. The amplification may worsen the signal to noise ratio where an individual's hearing has limited dynamic range because the noise will be amplified above the threshold level while the desired speech signal may have to be clipped or compressed to keep the signal within the most comfortable hearing range of the individual.

Although hearing impaired individuals often have unique and widely varying hearing problems, present hearing aids are limited in their ability to match the characteristics of the aid to the hearing deficit of the individual. Moreover, even if an aid is relatively well matched to an individual's hearing deficit under certain conditions, such as a low noise environment where speech is the desired signal, the aid may perform poorly in other environments such as one in which there is high ambient noise level or relatively high signal intensity level. The limitations of conventional analog hearing aids can be overcome in hearing aids which employ digital signal processing, such as disclosed in copending application Ser. No. 07/120,286 entitled Adaptive Programmable Signal Processing Hearing Aid, filed Nov. 12, 1987.

Feedback is a common and annoying phenomenon in hearing aids. The wearer usually hears it as a loud, high frequency squeal when he moves close to a sound-reflecting surface, such as a wall, or when he turns up the volume knob to a high setting. The feedback instability in a hearing aid has the same causes as feedback in a public address system. A sound comes into the microphone of the hearing aid, is amplified and sent out by the receiver. It then leaks back to the microphone and starts around the loop again. If the loop gain of the system (hearing aid plus acoustic feedback path) is greater than or equal to unity and the phase is a multiple of 360° at any frequency, then the output at that frequency will quickly rise in amplitude until it reaches the maximum output level for the aid.

The simplest way to stop feedback in an aid is to reduce the gain of the aid. If it is reduced sufficiently so that the gain around the loop is less than unity at all frequencies there will be no feedback instability. But the main purpose of hearing aids is to provide gain, so reducing the gain may not be a good solution for many people who have moderate to severe hearing losses. The other way to prevent feedback is to reduce the gain in the acoustic feedback path, the path between the receiver and the microphone. This can be done physically by using a tight fitting ear-mold without a vent-hole. The disadvantage is that tight fitting ear-molds can be uncomfortable and the use of a vent-hole may be necessary to give a desired frequency shaping.

Feedback in a digital hearing aid arises from exactly the same causes as in a conventional analog aid. The only slight difference is that digital aids tend to introduce a small delay to the signal. An analog aid will have a delay of the order of 100 microseconds whereas a digital aid may have a delay of perhaps 5 milliseconds. This causes no perceptual problems and it does not change whether or not feedback occurs, but it will change the rate at which instability climbs to the maximum level. Longer delays will cause a slower climb, although it may still be perceptually fairly fast.

SUMMARY OF THE INVENTION

In accordance with the present invention, acoustic feedback in digital signal processing hearing aids is suppressed by using signal processing techniques in the digital processor.

A first processing technique of the invention causes the data provided to the main signal processing path in the digital signal processor to be delayed by varying amounts over time, preferably in a periodic manner, to constantly vary the phase of the feedback signal and thereby disrupt the buildup of feedback resonances.

In a second technique of the invention, a digital filter in the digital signal processor receives the input data and has its coefficients adjusted so that the output of the filter is substantially an optimal estimate of the current input sample based on past input samples. The output of the filter is then subtracted from the input signal data to provide difference signal data which substantially cancels out the resonant frequencies. The difference signal data is then provided to the main signal processing path.

In a third technique of the invention, the acoustic feedback path from the output to the input of the hearing aid is modeled in the digital signal processor as a delay and a linear filter. The output of the main signal processing path in the digital signal processor is delayed and the delayed data passed through the linear filter, with the output of the filter then being subtracted from the input signal data to provide difference signal data which is provided to the main signal processing path. The input signal to and the delayed output signal data from the main processing path are used by a filter estimator to adjust the coefficients of the digital filter in the feedback path so that the signal passed through the feedback filter substantially corresponds in magnitude and phase to the acoustic feedback signal to thereby cancel the same.

Further objects, features and advantages will be apparent from the following detailed description when taken in conjunction with the accompanying drawings.

DESCRIPTION OF THE PREFERRED EMBODIMENT

Figure 1:
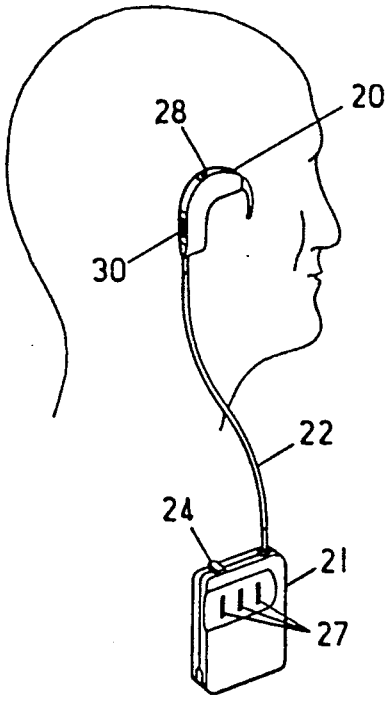
FIG. 1 is an illustrative view showing the major components of a digital signal processing hearing aid incorporating the present invention as worn by a user.

An illustrative view of one style of a programmable signal processing hearing aid incorporating the present invention is shown generally in FIG. 1, composed of an ear piece 20 and a body aid or pocket processing unit 21 which are connected by a wiring set 22. It is, of course, apparent that the hearing aid can be incorporated in various standard one piece packages, including behind-the-ear units and in-the-ear units, depending on the packaging requirements for the various components of the aid and power requirements. The pocket processing unit 21 includes a power on-off button 24 and mode control switches 27. The mode switches 27 can optionally provide selection by the user of various operating strategies for the system which suit the perceived preference of the user. A volume control dial 28 is also provided on the ear piece 20 to allow user control of the overall volume level.

Figure 2:
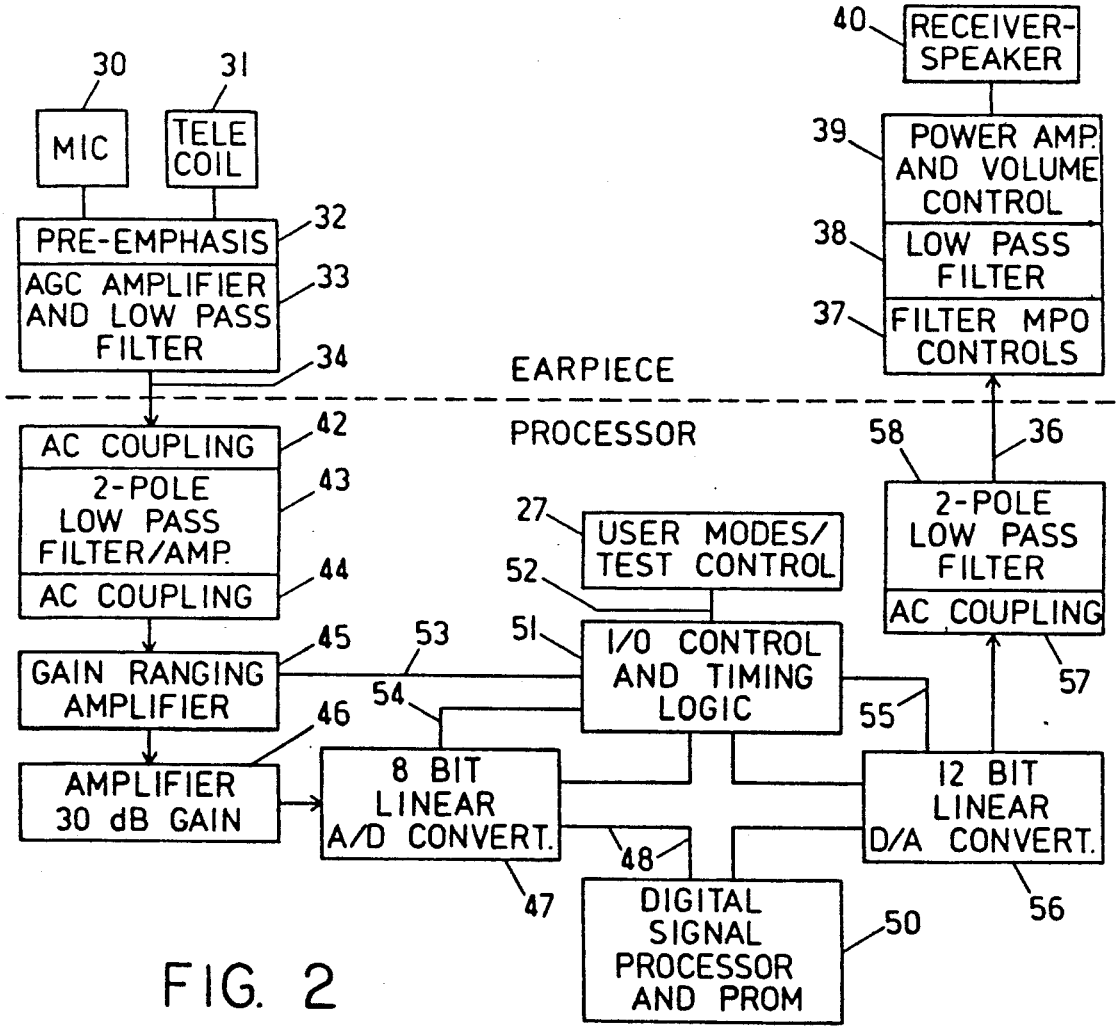
FIG. 2 is a schematic block diagram of the hardware components of the signal processing hearing aid incorporating the invention.

A hardware block diagram of the ear piece unit 20 and pocket processor unit 21 is shown in FIG. 2. The ear piece includes a microphone 30 which can be of conventional design (e.g., Knowles EK3027 or Lectret SA-2110). The ear piece may also optionally include a telecoil 31 to allow direct coupling to audio equipment. The output signal from the microphone 30 or telecoil is provided to an analog pre-amplifier/pre-emphasis circuit 32 which amplifies the output of the microphone (or telecoil) and provides some high pass filtering (e.g., 6 dB per octave) to provide a frequency spectrum flattening effect on the incoming speech signal which normally has a 6 dB per octave amplitude roll off. This pre-emphasis serves to make the voiced and unvoiced portions of speech more equal in amplitude, and thus better suited to subsequent signal processing. In particular, the pre-emphasis reduces the dynamic range of the speech signal and so reduces the number of bits needed in the analog to digital converter. The output of the pre-amplifier/pre-emphasis circuit is provided to an automatic gain control circuit and low pass filter 33. The automatic gain control (AGC) circuit attempts to maintain the long-term root-mean-square (RMS) input level at or below a specified value to minimize dynamic range requirements for the analog to digital converter which is used to convert the analog signal to a digital signal. Preferably, RMS inputs below 70–75 dB SPL (at 4 kHz) are amplified linearly with about 40 dB gain, resulting in a 45 mV RMS signal level (e.g., 0.125 V peak to peak for a 4 kHz sine wave) which will be provided to the analog to digital converter. Inputs between 75 dB and 95 dB are maintained at the 45 mV level for the long term average. Inputs above 95 dB preferably have a gain less than 15 dB, and will be hard-clipped at the one volt peak to peak level. However, it is apparent that the total gain received by the listener can be selected either more or less than these values depending on the subsequent digital signal processing and the analog output stage.

To minimize the interaction between speech modulation (syllabic) and the AGC circuit, the attack time is preferably approximately 300 milliseconds (msec) and the release time is approximately 2.5 seconds. This long term AGC function is desirable to allow the total gain to the user to be automatically adjusted to provide a comfortable listening level in situations where the user can control the signal level but not the noise level, for example, in using the car radio, watching television in a noisy environment, and so forth. The time-constants are chosen long enough so that the AGC is not affected by syllabic changes in speech level.

The output of the automatic gain control circuit is provided on signal lines 34 (forming part of the connecting line 22) to the main body or pocket processor unit 21. The ear piece also receives an output signal on lines 36 from the pocket processor. This output signal is received by a maximum power output control circuit 37 which is adjusted by the fitter. The signal then is provided to a low pass filter 38 and a power amplifier and volume control circuit 39 and finally to the receiver transducer or speaker 40 (e.g., Knowles CI-1762) for conversion to a corresponding sound. The analog output power amplifier 39 (e.g., an LTC 551 from LTI, Inc.) determines the overall system gain and maximum power output, each of which can be set by a single component change. The output of this amplifier is preferably hard limited to protect against malfunctions.

The signal on the line 34 from the ear piece is received by the pocket processor through an AC coupler 42 and is passed to a two pole low pass filter amplifier 43 and thence through an AC coupler 44 to a gain ranging amplifier 45 (e.g., Analog Devices AD 7118). The output of the gain ranging amplifier 45 is provided to a 30 dB gain amplifier 46 which provides its output to a linear analog to digital converter 47 (e.g., Analog Devices AD 7575). The A to D converter 47 is connected to provide its digital output to the data bus 48 of a digital signal processor 50 which may include a microprocessor, a random access memory and a programmable read only memory (PROM) for storing the program and the prescribed parameters adapting the hearing aid to a particular patient. An example of a suitable signal processor is a TMS 320E15 from Texas Instruments. The digital signal processor data bus is also connected to input/output control and timing logic 51 which is connected to the user mode control switches 27 by control lines 52, by control lines 53 to the gain ranging amplifier 45, and by a control line 54 to the analog to digital converter 47. The control logic is 30 also connected by a control line 55 to a 12 bit linear digital to analog converter 56 which is also connected to the data bus 48 of the digital signal processor. The analog output from the D to A converter 56 (e.g., an Analog Devices AD 7545 and a current to voltage converter) is provided through AC coupling 57 to a 2 pole low pass filter 58 which delivers the filtered output signal on the lines 36 to the ear piece. The amplifiers and filters may utilize, for example, TLC27M operational amplifiers and the logic circuitry is preferably 74HC series for low power operation.

Figure 3:
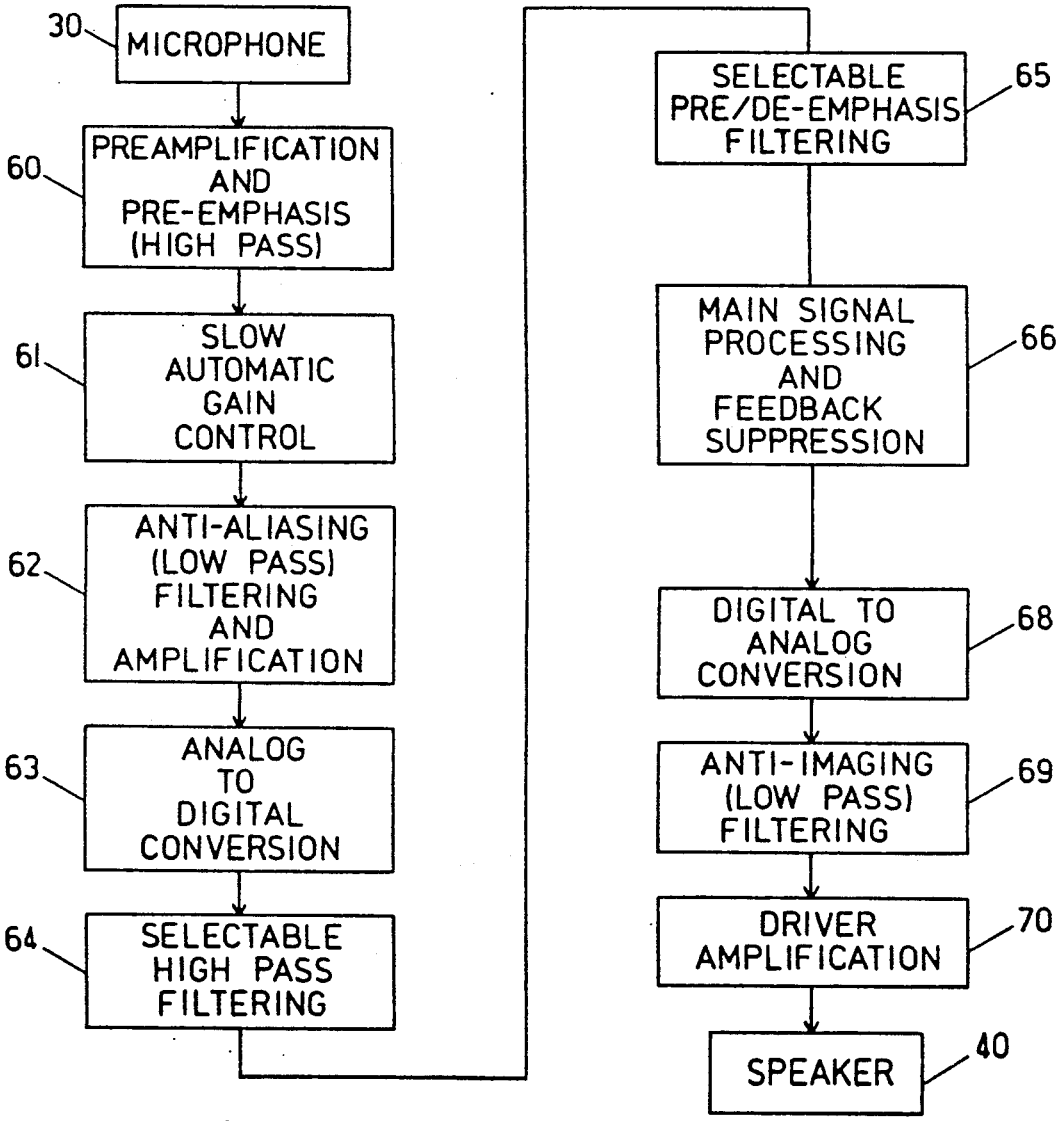
FIG. 3 is a signal flow diagram showing exemplary operations performed on the signals from the microphone to the speaker in a digital signal processing hearing aid of the invention.

A flow diagram of a preferred embodiment for signal flow through the hearing aid system is shown in FIG. 3. The input signal from the microphone 30 is initially preamplified and provided with pre-emphasis, preferably at 6 dB per octave (block 60) which is carried out by the pre-emphasis circuit 32, and then has slow automatic gain control performed on the amplified and pre-emphasized signal (block 61) which is performed in the AGC amplifier and filter section 33. The gain controlled signal is then passed through an anti-aliasing low pass filter (block 62) after which the analog signal is converted to digital data (block 63). The low pass anti-aliasing filtering is performed both in the AGC amplifier and low pass filter circuit 33 and in the 2 pole low pass filter and amplifier 43 to reduce the higher frequency content of the signal to minimize aliasing. For example, if the analog to digital conversion is performed at 14,000 samples per second, the anti-aliasing filtering preferably substantially attenuates signal power above about 7,000 Hz.

After analog to digital conversion, the processing of the signal is carried out digitally in the digital signal processor 50. The digital data is first subjected to a selectable high pass filtering step (block 64) which, if used, has a high pass frequency of about 100 Hz to filter out DC components of the signal and thereby get rid of DC offsets that may exist in the data.

The data is then optionally subjected to selectable pre or de-emphasis filtering (block 65). If pre-emphasis is selected, the filtering is flat to about 1 kHz and then rises at 6 dB per octave above that. De-emphasis is flat to about one kHz and falls at 6 dB per octave above that. A further option is no filtering at all. The choice between the filter options is made on the basis of the general shape of the patient's audiogram and subjective decisions made by the user during the fitting process.

The filtered data is then subjected to the main signal processing and feedback suppression processing (block 66).The present invention provides acoustic feedback suppression in a digital signal processing hearing aid in which a variety of operations may be performed in the main signal processing path in the signal processor 50. The main signal processing path is represented by the block 302 in the signal flow schematic diagrams of FIGS. 5 and 6. Examples of preferred main signal processes are described in copending application Ser. No. 07/120,286, now U.S. Pat. No. 4,887,299, and in an application filed simultaneously herewith by Malcolm Williamson, Kenneth Cummins and Kurt E. Hecox entitled Adaptive, Programmable Signal Processing and Filtering for Hearing Aids, Ser. No. 07/269,937, filed Nov. 10, 1988, the disclosures of which are incorporated herein by reference. Other main path processing may, of course, be used with the feedback suppression of the present invention.

After completion of the digital signal processing, the digital data is converted to an analog signal (block 68) in the digital to analog converter 56 and the converted signal is subjected to anti-imaging low pass filtering (block 69) carried out by the filters 58 and 38, to minimize imaging introduced by the digital to analog conversion. Finally the filtered signal is subjected to power amplification (block 70) in the power amplifier circuit 39 and is passed to the receiver or speaker 40.

The simplest way to stop feedback in a hearing aid is to reduce the gain of the aid. If it is reduced sufficiently so that the gain around the loop is less than unity at all frequencies there will be no feedback instability. But the main purpose of hearing aids is to provide gain, so reducing the gain may not be a good solution for many people who have moderate to severe hearing losses. The other way to prevent feedback is to reduce the gain in the acoustic feedback path, between the receiver and the microphone. This can be done physically by using a tight fitting ear-mold without a vent-hole. The disadvantage is that tight fitting ear-molds can be uncomfortable and the use of a vent-hole may be necessary to give a desired frequency shaping.

Acoustic feedback in a digital hearing aid arises from exactly the same causes as in a conventional analog aid with the slight difference that digital aids tend to introduce a small delay to the signal. An analog aid will have a delay of the order of 100 microseconds whereas a digital aid may have a delay of perhaps 5 milliseconds. This causes no perceptual problems and it does not change whether or not feedback occurs, but it will change the rate at which instability climbs to the maximum level. Longer delays will cause a slower climb, although it may still be perceptually fairly fast. Preferred auxilliary digital signal processing which may be performed on the signal path in the digital signal processor to reduce feedback is described below.

The feedback transfer function around a hearing aid comprises a gain and a phase at each frequency. The feedback can be disrupted either by reducing the gain or by changing the phase relationships. In accordance with the present invention, the phase relationship can be changed by including a variable delay line in the main signal path. As the delay changes, so does the phase. An equation in computer program pseudocode for implementing this delay function in the main signal processing path performed by the digital signal processor 50 is as follows:

$$y(t):=x(t-d)$$

where y(t) is the output signal of the delay function, x(t) is the input signal to the delay function, and d changes slowly in time from 0 to D and back again periodically with a constant period. It increases by 1 every dn'th sample until it reached D and then reverses direction and decreases at the same rate until it reaches 0, where it reverses direction again.

The choice of D and dn is a trade-off between feedback reduction and distortion of the signal. Large values for the two constants give more reduction and more distortion. The distortion sound has a warbling quality to it. Reasonable values are D=8 and dn=32, which result in an acceptable level of distortion.

Figure 5:
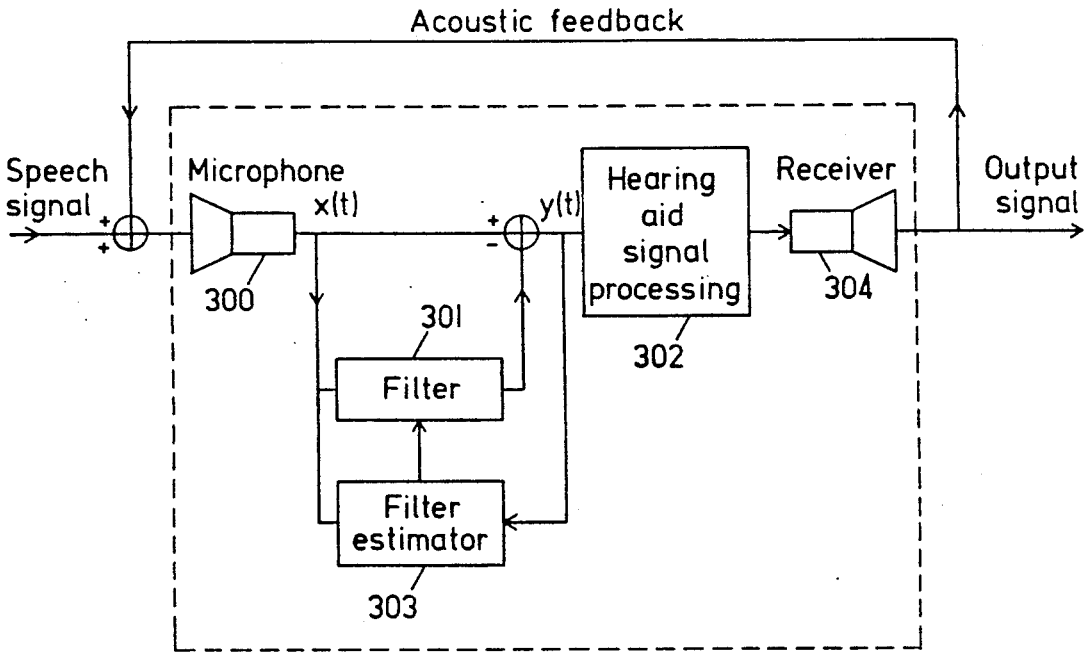
FIG. 5 is a schematic block diagram showing one form of adaptive suppression of acoustic feedback in accordance with the present invention.
Figure 6:
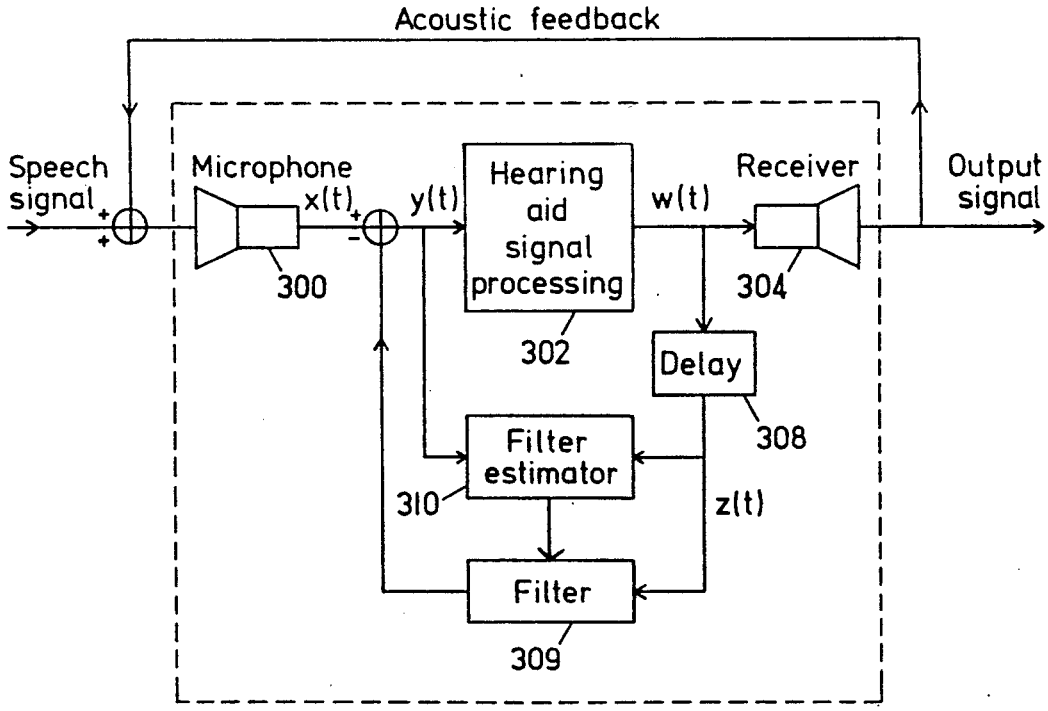
FIG. 6 is a schematic block diagram showing another form of adaptive suppression of acoustic feedback in accordance with the present invention.

A second signal process of the present invention for reducing feedback looks at the incoming signal and checks whether there are any strong tonal components. Feedback usually occurs at specific frequencies and is heard as a loud tone or whistle. If strong tones are present, they are attenuated in the digital signal processor 50 by means of an inverse filter. This is done by the technique of linear prediction. As shown schematically in FIG. 5, the incoming signal x(t) from the microphone 300 may be filtered by a slowly time-varying filter 301, and the filtered signal is subtracted from x(t) to yield an output signal y(t) which is provided to the remaining main signal processing path 302. The output of the digital filter 301 is an optimal estimate of the current input sample based on past input samples. Given speech input, the inverse filter will provide a mild high-frequency emphasis; however, when feedback (tonal) components are in the input signal, the inverse filter, under control of a filter estimator 303, will provide a notch filter centered at the frequency of the feedback signal. The inverse filter is adaptive, being updated each sample as a function of the input signal. It is understood that the signal processing blocks 301, 302 and 303 illustrated in FIG. 5 are carried out within the digital signal processor 50 of FIG. 2.

The program equations executed for these functions are as follows:

$$y(t):=x(t)-\text{sum over } n(c(n)*x(t-n))$$

for n=1 thru N $$c(n):=c(n)+B*y(t)*x(t-n)$$

for n=1 thru N $$B:=BT/(R0+BC)$$

R0 is an estimate of the mean square energy in the input signal and BC and BT are constants. R0 can be implemented as follows:

$$R0:=R0+(x(t)*x(t)-R0)*RT$$

where RT is a constant.

The implementation in the digital signal processor of the first equation is a filter whose coefficients c(n) vary slowly and are calculated by the other equations. The constants BT and RT determine how fast the algorithm adapts to changing signals. The more important of these two is BT. A value of about $2^{-12}$ is preferred, giving a time constant of about 250 milliseconds. The preferred value for RT is about $2^{-11}$, for a time constant of 150 milliseconds. This governs the length of time over which the short term energy estimate R0 is made. The constant BC helps to slow down the adaptation during periods of low signal and is set to a value of $2^{18}$. The parameter B changes slowly. Thus, it is not necessary to update B every sample. The preferred update rate which minimizes computation without compromising performance is to compute B once every 512 samples.

The number, N, of coefficients can have a value of 2 or more. The more coefficients there are, the greater is the amount of computational power needed in the algorithm. A large number of coefficients would give the possibility of eliminating several tones from the signal. But a small number of coefficients gives less distortion. Values of 2 to 6 are preferred.

In a third process of the invention, the input and output signals of the hearing aid are analyzed and the transfer function around the acoustic feedback path is estimated. The transfer function is used to form an estimate of the acoustic feedback signal which is then subtracted or cancelled from the input signal, as illustrated schematically in FIG. 6. This method models the hearing aid input from the microphone 300, x(t), as the sum of a desired input signal (e.g. speech) and a noise signal, the acoustic feedback signal. The acoustic feedback signal estimate is obtained by filtering the main signal processing path output, w(t), (a delayed and processed version of the input) with the estimate of the acoustic feedback path transfer function. The transfer function of the acoustic feedback is modeled as a pure delay function 308 (to compensate for the time it takes for the acoustic signal to travel from the hearing aid output to the microphone input) and a linear filter 309 (to compensate for the frequency shaping imposed by the acoustic environment), with both functions in a feedback path from the output to the input of the main signal processing path. A filter estimator 310 uses the input signal y(t) and the delayed output signal z(t) (the output signal w(t) after the delay function is performed on it) to determine the coefficients of the filter 309. The preferred value of the delay is 12 samples, given a 14 kHz sampling rate. However, this value may be fit to each individual situation if necessary. The filter transfer function estimate is updated each sample as per the following equations:

$$y(t):=x(t)-\text{sum over } n(c(n)*z(t-n+1))$$

for n=1 thru N $$c(n):=c(n)+B*y(t)*z(t-n+1)$$

for n=1 thru N $$B:=BT/(R0+BC)$$

where BT and BC are constants and the energy estimate R0 may be implemented as:

$$R0:=R0+(x(t)*x(t)-R0)*RT$$

where RT is a constant.

The input signal to the digital signal processor from the microphone (after A to D conversion) is x(t). The feedback function is executed to form y(t). Then further processing in the main signal processing path 302, for example, frequency shaping or noise reduction produces the final output w(t). A delayed version of the output, z(t), is filtered to yield the feedback signal estimate which is subtracted from the input, x(t).

The implementation in the digital signal processor of the first equation above for y(t) is a filter whose coefficients c(n) vary slowly and are calculated by the other equations. The constants BT and RT determine how fast the algorithm adapts to changing signals. The more important of these two is BT. A value of about $2^{-11}$ is preferred, giving a time constant of about 150 milliseconds. The preferred value for RT is about $2^{-5}$, for a time constant of about 2.5 milliseconds. This governs the length of time over which the short term energy estimate R0 is made. The constant BC helps to slow down the adaptation during periods of low signal and is set to a value of $2^{25}$. To save computation, the variable B need not be recalculated at each sample interval. B changes slowly and it is sufficient to calculate it once every 512 samples.

The number, N, of coefficients can have any value. The more coefficients there are, the greater is the amount of computational power needed in the algorithm. A large number of coefficients gives a better possibility of modeling the feedback path accurately, but a small number of coefficients has less effect on the speech signal. Also, larger numbers of coefficients can cause problems with numerical accuracy. Given these conflicting requirements, values of 6 to 12 for N are preferable.

Figure 4:
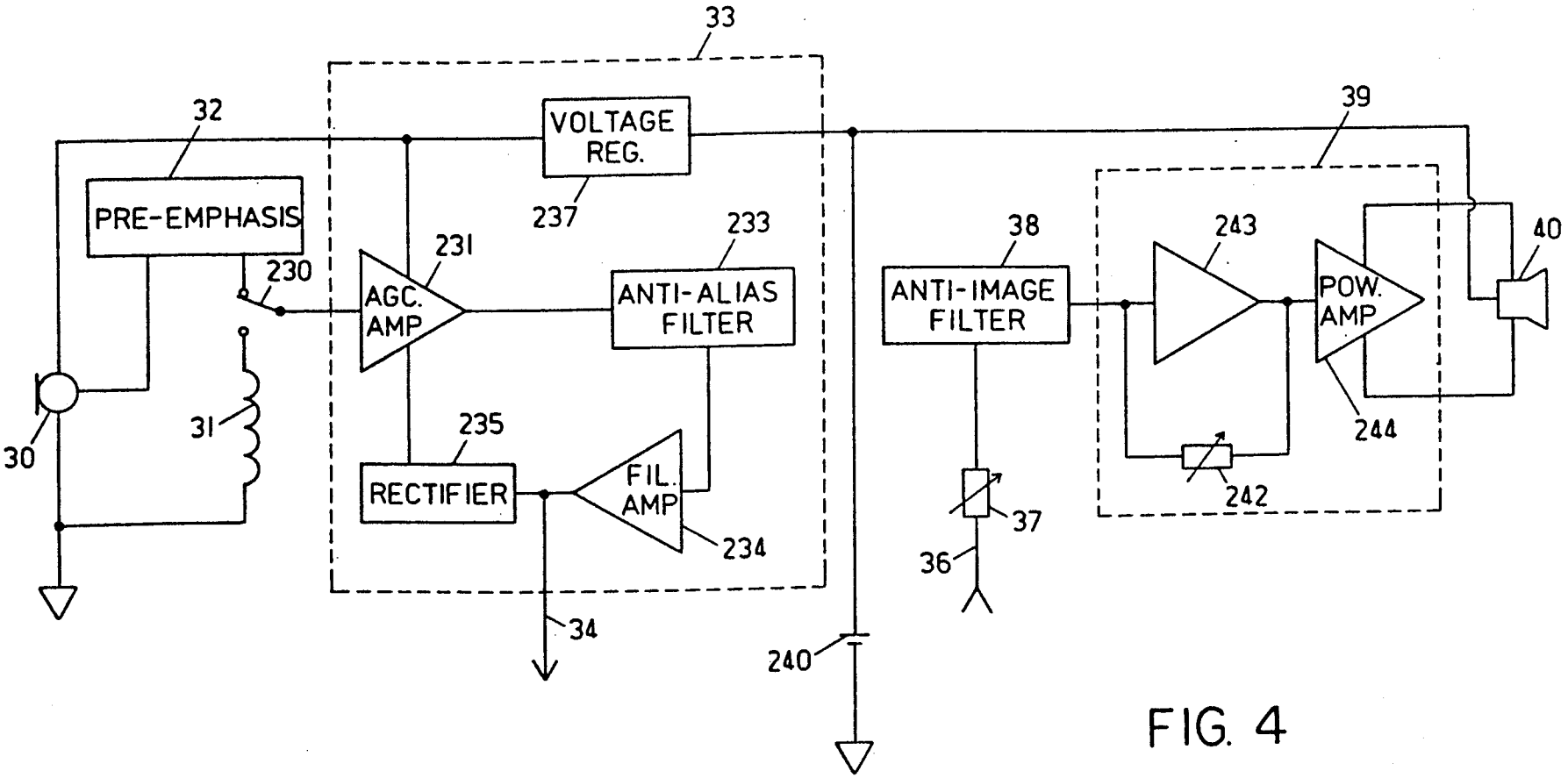
FIG. 4 is a schematic block diagram showing the hardware components of the ear piece portion of the hearing aid system.

A somewhat more detailed block diagram of the ear piece circuit portion of the hearing aid is shown in FIG. 4. A switch 230 allows the input to be taken either from the microphone 30 through the pre-emphasis circuit 232 or from the telecoil 31. The input signal goes into the circuit 33 which includes an automatic gain control amplifier 231, the output of which is received by the low pass anti-aliasing filter 233. The output of the filter 233 is passed through a filter amplifier 234 and is provided on the line 34 to the digital signal processing components in the processor unit. The output of the filter 234 is also provided to a rectifier 235 which feeds back to the AGC amplifier 231 to control its output level. The AGC amplifier receives its power (as does the microphone 30) from a voltage regulator 237 which is supplied from a low voltage battery source 240 in the ear piece.

The signal on the lines 36 from the pocket processor portion of the hearing aid is received in the ear piece and passed through an adjustable attenuator 37 which is adjusted by the hearing aid fitter, and thence the signal passes through the anti-imaging filter 38 to the power amplifier section 39 which drives the receiver speaker 40. The power amplifier section 39 is supplied directly with power from the voltage source 240 and includes a voltage adjustment 242 operated by the dial 28 which controls the gain of an amplifier 243 which, in turn, supplies the power amplifier 244.

It is understood that the invention is not confined to the particular embodiments set forth herein, but embraces all such modified forms thereof as come within the scope of the following claims.

What is claimed is:

1. A digital signal processing hearing aid system having feedback suppression comprising:

(a) input means for providing an electrical signal corresponding to a sound signal;

(b) analog to digital converter means for converting the signal from the input means to digital data at a selected sample rate;

(c) digital signal processing means for receiving the input signal digital data from the analog to digital converter means and, through a main signal processing path, providing processed output data, the digital signal processing means including:

(1) digital filter means, having filter coefficients which can be varied, receiving the input signal data and providing output data;

(2) means for subtracting the output data of the digital filter means from the input data to produce difference signal data which is provided as said processed output data;

(3) means for calculating the coefficients of the digital filter means based on the input signal data and the difference signal data such that the output of the digital filter means is an optimal estimate of the current input sample based on past input samples;

(d) digital to analog converter means for converting the processed output data from the digital signal processing means to an analog signal; and (e) means for converting the analog signal to a corresponding sound.

2. The hearing aid system of claim 1 wherein the digital filter means and the means for calculating the coefficients are carried out in the digital signal processing means by implementation of the following program equations:

$$y(t):=x(t)-\text{sum over } n(c(n)*x(t-n))$$

for n−1 through N $$c(n):=c(n)+B*y(t)*x(t-n)$$

$$B:=BT/(R0+BC)$$

where x(t) is the input signal data to the digital signal processing means, y(t) is the difference signal data provided to the main signal processing path, BT and BC are selected constants, R0 is an estimate of the mean square energy in the input signal, and N has a value of two or more.

3. The hearing aid system of claim 2 wherein N has a value in the range of 2 to 6.

4. The hearing aid system of claim 2 wherein R0 is determined by the digital signal processing means by implementation of the equation:

$$RO:=RO+(x(t)*x(t)-RO)*RT$$

where RT is a constant.

5. The hearing aid system of claim 4 wherein BT has a value of about $2^{-12}$, RT has a value of about $2^{-11}$, and BC has a value of about $2^{18}$.

6. A digital signal processing hearing aid system having feedback suppression comprising:

(a) input means for providing an electrical signal corresponding to a sound signal;

(b) analog to digital converter means for converting the signal from the input means to digital data at a selected sample rate;

(c) digital signal processing means for receiving the input signal data from the analog to digital converter means and, through a main signal processing path, providing processed output data, the digital signal processing means including:

(1) a feedback path from the output of the main signal processing path to the input of the main signal processing path wherein the data through the feedback path is subtracted from the input data to produce difference signal data and the difference signal data is provided to the main signal processing path, the feedback path including delay means for delaying the data passed therethrough by a selectable time period and digital filter means, having coefficients which are adaptively changeable, for filtering the data passed therethrough, and (2) means for estimating the filter coefficients of the digital filter means as a function of the difference signal data and the delayed output signal data from the delay means such that the feedback signal passed through the delay means and the digital filter means, when subtracted from the input signal data, substantially cancels the acoustic feedback component of the input signal to the hearing aid system;

(d) digital to analog converter means for converting the processed output data from the digital signal processing means to an analog signal; and (e) means for converting the analog signal to a corresponding sound.

7. The hearing aid system of claim 6 wherein the digital filter means and the means for estimating the filter coefficients are carried out in the digital signal processing means in accordance with the following program equations:

$$y(t):=x(t)-\text{sum over } n(c(n)*z(t-n+1))$$

for n=1 through N $$c(n):=c(n)+B*y(t)*z(t-n+1)$$

for n=1 through N $$B:=BT/(R0+BC)$$

wherein the input signal to the digital signal processing means is x(t), the difference signal data that is provided to the main signal processing path is y(t), z(t−n+1) is the output data from the main signal processing path as delayed by the delay means, BT and BC are selected constants, R0 is an estimate of the mean square energy in the input signal, and N is at least 2.

8. The hearing aid system of claim 7 wherein N has a value in the range of 6 to 12.

9. The hearing aid system of claim 7 wherein R0 is determined by the digital signal processing means by implementation of the equation:

$$RO:=RO+(x(t)*x(t)-RO)*RT$$

where RT is a constant.

10. The hearing aid system of claim 9 wherein the constant BT has a value of about $2^{-11}$, RT has a value of about $2^{-5}$, and BC has a value of about $2^{25}$.

* * * * *